United States Patent [19]

Krieg

[11] Patent Number: 5,020,337

[45] Date of Patent: Jun. 4, 1991

[54] COMBINATION ICE PACKAGE AND EXPANDABLE COOLER

[76] Inventor: David F. Krieg, 19 Nightengale La., Dubuque, Iowa 52001

[21] Appl. No.: 463,476

[22] Filed: Jan. 11, 1990

[51] Int. Cl.[5] ..... F25D 3/02

[52] U.S. Cl. ..... 62/464; 229/103; 229/138; 229/127

[58] Field of Search ..... 62/459, 458, 464; 229/103, 138, 127

[56] References Cited

U.S. PATENT DOCUMENTS 2,810,506 10/1957 Kessler ..... 229/138 X
3,520,467 7/1970 Drnec et al. ..... 229/127
4,777,992 10/1988 Olger ..... 62/459 X

FOREIGN PATENT DOCUMENTS 712493 9/1966 Italy ..... 229/127

*Primary Examiner*—Albert J. Makay
*Assistant Examiner*—John Sollecito
*Attorney, Agent, or Firm*—Bradford E. Kile; Ruffin B. Cordell

[57] ABSTRACT

A receptacle for packaging particulate ice and for selectively storing and cooling consumables including a box type receptacle with an extendable upper portion consisting of folded cardboard flaps. The upper portion of which includes expanding top flaps which fold to form a top seal through the use of frictional engagement offset notches. The upper portion of the structure is provided with circular access areas through which drinks may be inserted while being consumed.

5 Claims, 3 Drawing Sheets

COMBINATION ICE PACKAGE AND EXPANDABLE COOLER

BACKGROUND OF THE INVENTION

This invention relates to a novel method and apparatus for packaging ice or other commodities and for storing articles to be kept cool. More specifically, this invention relates to an expandable package which can be used both to market granulated ice or other commodities as well as to be used as a portable ice chest.

In order to accommodate the various outdoor activities enjoyed by people today, it has long been known to utilize various portable ice receptacles to keep food and drinks cool while away from sources of power and refrigeration. These so-called ice chests have taken on various forms. The earliest form of ice chest was a double walled metal container with the space between the walls filled with some type of insulation. Such ice chests, or ice boxes as they were known, were prevalent throughout the early part of the century and were used to a fair extent. Unfortunately, these presented problems of both weight and bulkiness in use and led to later developments.

Subsequently, the advent of the plastics age brought with it the development of the insulated plastic ice chest. While the weight required to provide refrigerated goods and ice with a significant degree of insulation was significantly reduced, these plastic ice chests remained bulky and relatively difficult to store and produce for use when needed.

Users of portable ice receptacles have always been faced with the problem of transporting bulky ice chests when embarking on long outings, only to be again faced with the problem of retrieving the receptacle for storage after use. In order to overcome these difficulties, several solutions have been proposed. Relatively light ice chests made out of styrofoam or similar materials have found fair acceptance among the consuming public. Unfortunately, such containers while reducing the weight of such devices considerably have retained the disadvantages of being bulky and difficult to store and produce for use when needed. These devices have the added disadvantage of being very brittle and susceptible to breakage and leakage when in use.

In order to more fully address these problems, some have proposed solutions incorporating lightweight designs. One of the earliest was a five-walled jacket type container, the walls of which were independent flaps and would simply fold up around objects to be kept cool. This design was not waterproof and met with limited acceptance. A more modern concept has employed a composite layer design consisting of plastic and nylon layers in a soft sided, box-type construction. Still others have proposed a design employing an inflatable plastic envelope into which articles to be kept cool are inserted.

Perhaps the most basic cooler has employed a simple insulated bag into which both ice and objects to be kept cold are inserted. While such a device is convenient, it lacks any structural integrity and is prone to leakage and rupture.

Like those who proposed solutions in the portable ice chest art, those seeking to provide designs for the packaging and marketing of ice have similarly failed to appreciate the advantages set forth in the present invention. The most widely used package for marketing ice is a clear plastic bag. Such packaging is satisfactory provided the ice sold is transported only a short distance from factory to retail outlet and is displayed for sale in a relatively protected environment. Consumers are quite familiar with the hazards of handling such bags of ice without a great amount of care. The thin plastic used in such bags tears easily even under normal handling. Spillage, leakage, and general contamination of the ice occurs upon rupture of the plastic package.

Ice as it is presently sold must be displayed for sale in refrigerated containers in which the ice to be sold cannot be stacked more than a few feet deep. The fragile nature of the bags in which the ice is marketed requires retailers to insure that the ice is not stacked beyond this relatively low level. In addition, the irregular shape of the cylindrical bags of ice make stacking and shipping a difficult and unstable task.

The above noted designs fail to accommodate several of the principle difficulties encountered with the use of portable ice chests and traditional ice packages. The difficulties enumerated in the proceeding are not intended to be exhaustive but rather illustrative among many which may tend to reduce the effectiveness and ease of use of such portable cooling devices and ice packaging methods. Other noteworthy problems may also exist; however, those presented above should be sufficient to demonstrate that the portable ice chest designs appearing will admit to worthwhile improvement.

OBJECTS OF THE INVENTION

It is therefore the general object of this invention is to provide a novel ice package and ice chest receptacle which obviates or minimizes difficulties of the type previously encountered.

It is the specific object of the invention to provide a container for the storage, distribution and marketing of granulated ice which will efficiently and compactly package the ice.

It is another object of the invention to provide a package which will make the ice contained therein easy to handle and store.

It is still another object of the invention to provide packaging for granulated ice which conforms to an easily stackable shape.

It is still another object of the invention to provide a container for the marketing and distribution of ice which will serve as a refrigeration device for objects to be placed therein.

It is a further object of the invention to provide an expandable container which can increase its size to allow the introduction of objects to be refrigerated therein.

It is still a further object of the invention to provide an expandable design which will accommodate the refrigeration of a substantial percentage of its own volume of objects to be introduced therein.

It is yet a further object of the invention to provide an ice container which forms a integral and stable structure in its expanded state.

It is still a further object of the invention to provide an ice packaging device which includes a self opening feature.

It is still a further object of the invention to provide an ice chest apparatus which includes a locktop closure feature.

It is still a further object of the invention to provide and ice chest apparatus which in its expanded form includes a device for keeping drinks cool while being consumed.

It is yet still another object of the invention to provide an ice chest apparatus which provides for access to the interior thereof on a limited basis.

BRIEF SUMMARY OF THE INVENTION

A preferred embodiment of the invention which is intended to accomplish at least some of the foregoing objects includes a four-sided box like container including a reinforced bottom into which granulated ice particles are introduced. A plastic bag encloses the ice to maintain the waterproof integrity of the device. The top of the device is constructed of expandable sidewalls terminating in two flap-type extension which lock to form the top of the structure in its expanded state. The two expandable side members are folded in a novel arrangement to allow the structure to quickly expand from a compact packaging mode to an expanded refrigeration mode. The two locking flaps include engaging features which allow the system to become structurally stable and relatively airtight when its in its expanded form. When in its expanded form, the ice receptacle will accommodate a substantial portion of its original volume of articles to be refrigerated within its interior. The two upper flaps of the device include star shaped slits therein which form a circular opening to the interior of the receptacle. This opening allows the introduction of drinks into the ice chamber to retain drinks at a low temperature while being consumed.

The system is first utilized to package ice. Ice is packaged within the interior of the container while in its unexpanded state. The ice is shipped and sold in this compact, highly stable, and easily stackable form. The exterior of the container forms a neat rectangular structure which accommodates these features. After purchase, the user expands the structure to reveal an substantial amount of empty space within the interior of the ice chest apparatus. The ice is removed and the articles to be refrigerated are placed in the receptacle and then the ice is replaced on top of them. In its expanded state, the receptacle is now portable and ready to be used for whatever purpose desired.

To expand the container, the user removes an adhesive tape fastener from the apparatus and due to the tension placed within the structure itself, the expandable portion of the receptacle spontaneously unfolds revealing two extended flaps on the interior of the container. The user completely unfolds these flaps by pulling them outwardly of the container. The upper portions of the interior flaps form the top wall of the container and will fold towards each other, ultimately engaging with the side walls to form a structurally stable six-sided ice chest.

THE DRAWINGS

Other objects and advantages of the present invention will become apparent from the following detailed description of the preferred embodiment thereof taken in conjunction with the accompanying drawings, wherein.

DETAIL DESCRIPTION

Figure 1:
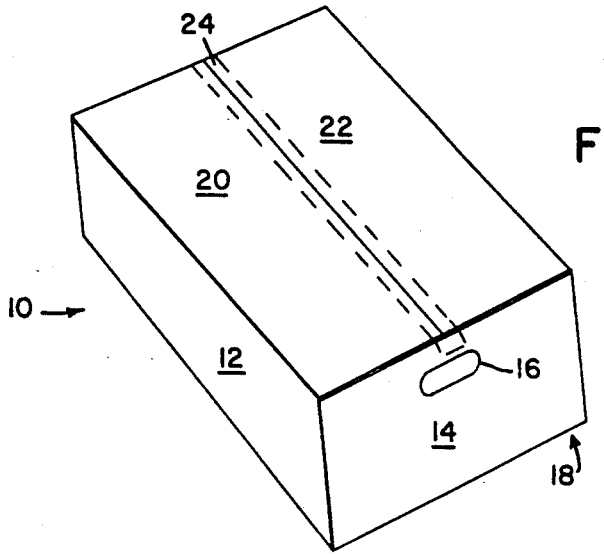
FIG. 1 is a perspective view of the ice receptacle of the present invention in its closed, unexpanded state.

Referring now to the drawings, wherein like numerals indicate like parts; in FIG. 1 there will be seen an operative context of the present invention. More particularly, the present invention is formed by the box type receptacle 10, such receptacle consisting of side walls 12, end walls 14, and bottom 130. Centered in the upper portion of end walls 14 are hand slots 16. FIG. 1 depicts the ice receptacle of the present invention in its unexpanded state. In this state, the upper surface of the ice receptacle is formed by lower expandable side portions 20 and 22. The seam between expandable side portions 20 and 22 is secured by means of adhesive tape 24 running the length of the common seam therebetween. The bottom of the ice receptacle is formed by a reinforced surface eighteen (not shown). The ice receptacle of the present invention may be constructed of a variety of materials. Preferably, it is made of a high strength two layer cardboard material with a corrugated medium interposed between the two layers. Such a material provides both good strength characteristics and an additional degree of insulation to the device. This material has the added advantage of readily accepting labeling or other advertising information on the outer surface thereof. The inner surface may be waxed or similarly treated to provide the structure with further waterproof characteristics.

Figure 2:
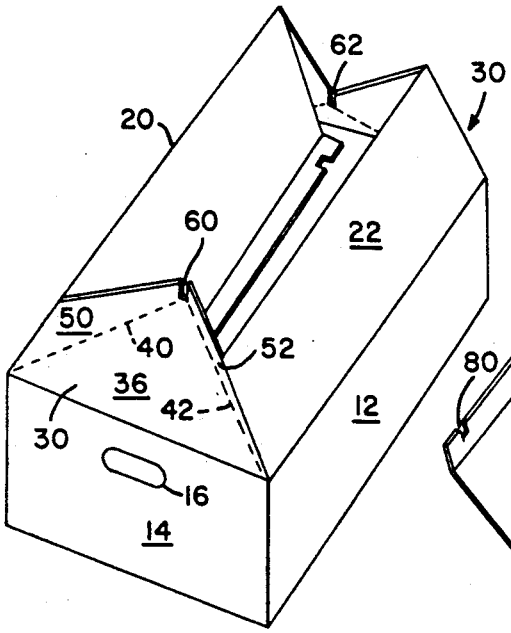
FIG. 2 is another perspective view of the ice receptacle of the present invention in its partially expanded state.

FIG. 2 depicts the ice receptacle in its spontaneously opened, partially extended state. Ice receptacle 10 is symmetric with respect to both side and end faces. Accordingly, common numerals are used to depict like parts. This position reveals expandable end panels 30. The end panels are further divided along perforated lines 40, and 42 to form upper end portions 50, and 52, and main end portion 36. The apex juncture of end surfaces 50, 36, and 52 forms a notch 60. Similarly the apex of opposite end 30 surfaces form notch 62. In its partially folded state shown in FIG. 2, the respective angles between surfaces 50 and 30 and the angle between surfaces 30 and 52 consist of acute angles. As the box unfolds, these angles increase into the obtuse angles shown in FIG. 3.

Figure 3:
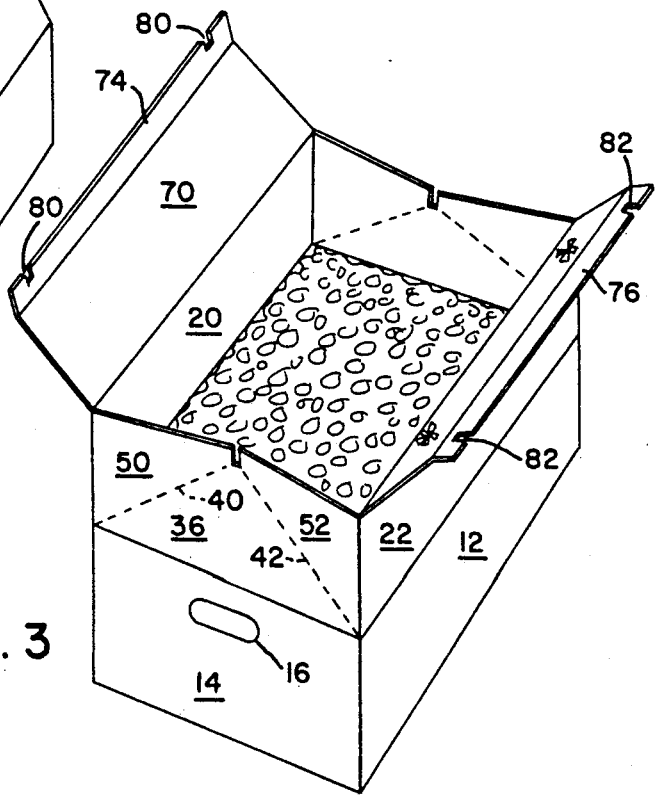
FIG. 3 is again a perspective view of the present invention in its fully expanded and open state showing both the construction of the respective portions of the ice receptacle as well as the ice granules contained therein.

FIG. 3 depicts the ice receptacle of the present invention in a fully extended but open state. End walls 30 are in a fully extended position showing the angles between end wall parts 50 and 36 to be at a maximum of about 160 degrees. In this fully extended state, upper sidewalls 20 and 22 lie in a vertical plane. The interior of the ice receptacle of the present invention is filled with granulated ice particles in cubes or other arbitrary shapes.

Attached to and coextensive with upper side flaps 22 and 20 are top flaps 70 and 72. Extending from side flaps 70 and 72 at their uppermost edges are locking flaps 74 and 76. Formed in locking flaps 74 and 76 are locking notches 80 and 82. The ice contained in the interior of the ice receptacle of the present invention is enclosed in a plastic bag (not shown) to insure the waterproofness of the overall system. Referring particularly to FIGS. 2 through 5, the operation of the present system will be explained. With the ice receptacle in its closed and fully compact position of FIG. 1, the user removes tape 24. Upon doing so, the internal tension formed by cardboard folds 40 and 42 forces end flaps 30 and 32 upward, allowing the user access to upper flaps 20 and 22. The user then fully unfolds the expandable portion of the ice receptacle and brings top flaps 70 and 72 up and out of the receptacle. Thus the device is in the position of FIG. 3. In doing so, end flaps 30 and 32 expand to their slightly canted appearance lying at about 25 degrees from the vertical. Upper side flaps 20 and 22 lie in the vertical plane.

The user then removes the granulated ice particles contained therein and places the objects to be refrigerated within the plastic bag provided. The granulated ice particles are then poured over the articles to be refrigerated. In its expanded form, the ice receptacle of the present invention will accommodate up to 24 standard size soft drinks comfortably or their equivalent. As an alternative to the plastic waterproofing bag, the seams of ice receptacle 10 may be sealed with wax, plastic, or other waterproofing material to obviate the need for such a bag.

Figure 4:
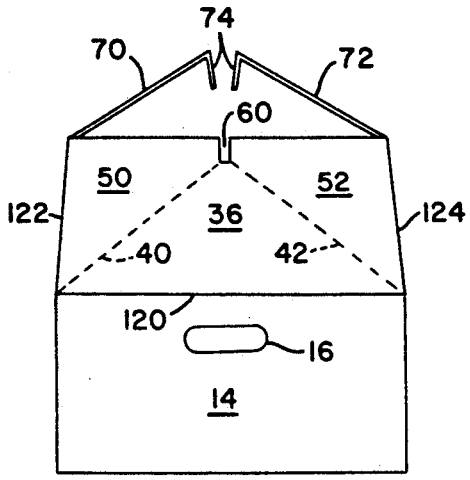
FIG. 4 is a side view of the ice receptacle of the present invention in its fully expanded and partially closed state showing the detail of the engagement of the upper flaps with the side walls.

Once the objects to be refrigerated are placed within the cavity of ice receptacle 10, top flap 70 and 72 are folded downward along seams 78 and 79 as shown in FIG. 4. Locking flaps 74 and 76 are similarly folded downwardly to be received within locking groves 60 and 62. Locking groove 60 and 62 and locking grooves 80 and 82 engage to form a frictional type attachment and provide the receptacle 10 with an insulated lid.

Figure 5:
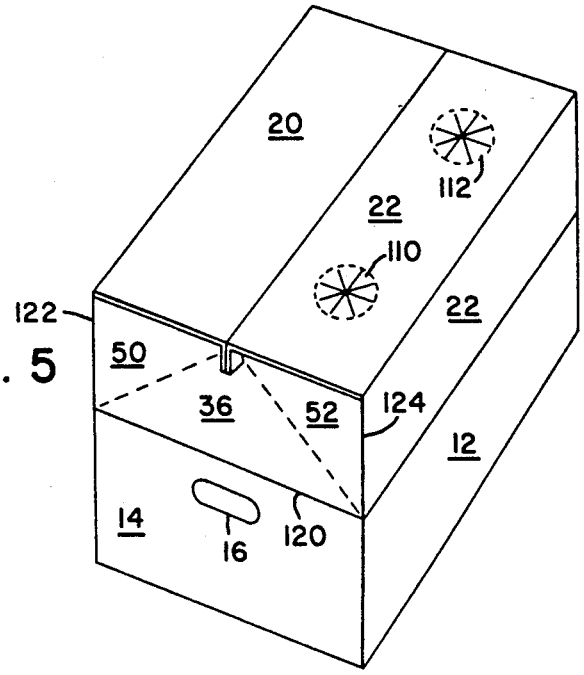
FIG. 5 is a perspective view of the present invention showing the ice receptacle in a fully expanded and closed position.

FIG. 5 depicts receptacle 10 in its closed and fully extended position. It is important to note here that while upper sidewalls 20 and 22 line the vertical plane, upper end walls 30 and 32 do not. Rather, each of the individual sections of the sidewalls lies in a different angular plane with respect both to each other and to the lower end wall plane. Main endwall portion 36 forms approximately a 25 degree angle with the plane of end wall 14 along seam 120. Upper end portion 50 lies in a vertical plane but forms approximately a 65 degree angle with the plane of side wall 20 along seam 122. Upper end portion 52 similarly lies in the vertical plane but forms approximately a 65 degree angle with the plane of side wall 22 along seam 124.

In its fully extended and closed position, it will be understood that the ice receptacle 10 is a highly stable and structurally sound device. The aforementioned angles along seams 120, 122, and 124 form a triangular trestle type support through upper end panels 36, 50, and 52 in conjunction with upper panels 70 and 72 at locking points 60, 62, 80 and 82. End portions 14 are symmetric in all respects. Thus, upper end portions 30 lie in directly offsetting force planes. Accordingly, receptacle 10 is provided with a great deal of structural stability.

Figure 6:
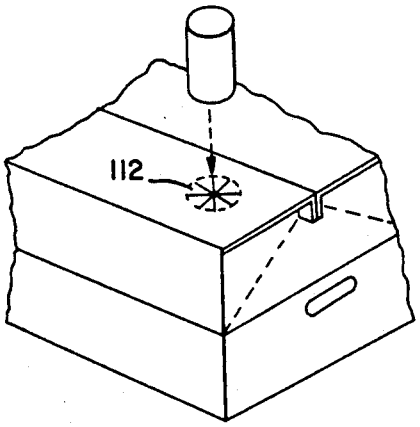
FIG. 6 is a cut-away perspective view of the present invention detailing the star access structure which accommodates drinks while being consumed.
Figure 7:
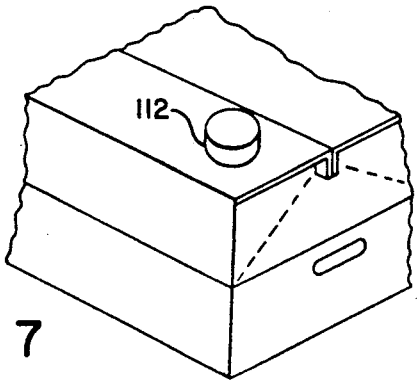
FIG. 7 is again a cut-away perspective view of the present invention showing a beverage can inserted through the star access receptacle.

With particular emphasis on FIGS. 6 and 7, the star access structures of the present invention will be explained. Access receptacles 110 and 112 are formed by the intersection of 8 slit like openings centering about a single point. The end points of these slit like openings are circumscribed by a perforated ring which allows each of the triangular portions formed between the slit like openings to bend readily. This provides an opening to the interior of the ice receptacle which will accommodate a standard size beverage can in a frictional engagement. In use, the user may insert such a standard size beverage can through access openings 110 or 112 to maintain it at a low temperature while being consumed.

Because the present invention is intended to be constructed of cardboard, polyurethane, or other continuous sheet stock, it is probable that the individual receptacles will be die cut from continuous stock. To accommodate this method of construction and to fully understand the construction of receptacle 10, FIG. 8 displays the blank die cut of the device. Flaps 132, 133, 134, and 135 fold upwardly to form bottom surface 18. Side walls 12 and end walls 14 are similarly shown. Upper side walls 20 and 22 are shown between upper end walls 36. Top flaps 70 and 72 are shown lying between upper side flaps 20 and 22 and locking flaps 74 and 76. Locking notches 80 and 82 are similarly shown. Hand holds 16 are punched in the upper center of end portions 14. Finally, anchoring tabs 142 and 144 are shown on the left most edges of side portions 12 and upper side portion 20.

Figure 8:
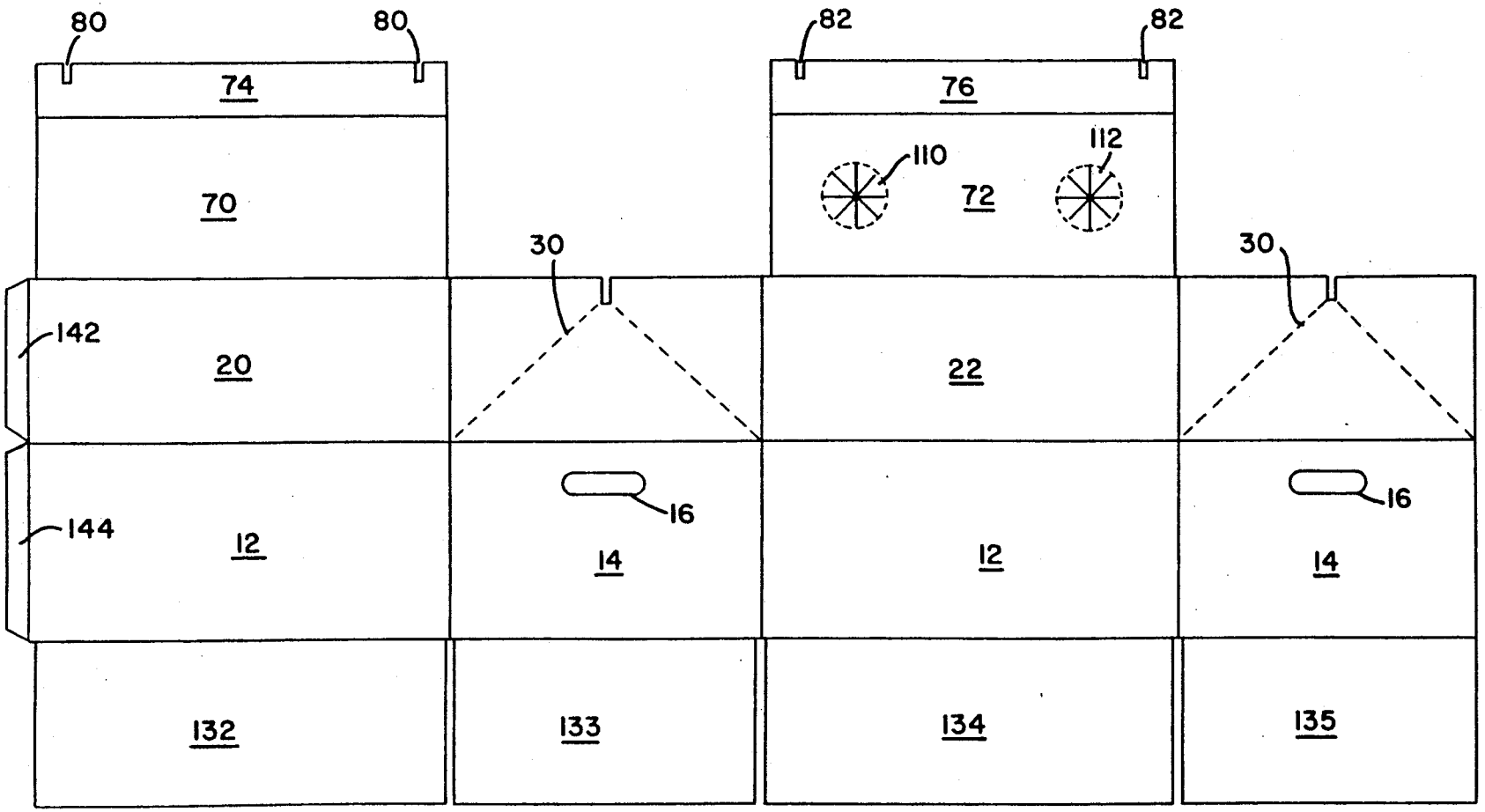
FIG. 8 is a top view of the exploded blank pattern of the ice receptacle of the present invention.

Construction of ice receptacle 10 is accomplished by folding the blank shown in FIG. 8 in a straight forward manner. Flaps 132 through 135 are folded inwardly to form the bottom position 18. The folds between side panels 12 and end panels 14 are made to bring anchoring flap 144 into engagement with end panel 14. Similarly, the folds between upper side panels 20 and 22 and end panels 36 are made to bring anchoring tab 142 into engagement with end panel 36. Finally, top flaps 70 and 72 are folded down into the interior of the receptacle to allow it to be placed into its unexpanded state. To collapse the receptacle, upper end panels 36 are drawn inwardly folding them along perforations 50 and 52. This is continued until upper side flaps 20 and 22 are folded down and lie completely in the horizontal plane. The seam between upper side flaps 20 and 22 is secured with tape 24 for storage and marketing.

Summary of Primary Advantages

In use, beverages such as beer or soda, other liquid drinks, or articles to be refrigerated are stored within receptacle 10 for use in a outdoor or other recreational environment. The lightweight character of receptacle 10 makes it ideal for these purposes. The present invention avoids the previous disadvantages of a heavy and bulky ice chest required to keep things cool while out of doors. Users may employ handholes 16 to transport receptacle 10 expeditiously while the structural integrity of the unit allows it to be used without taking great care for its protection.

Primary disadvantages of previous systems were storage between uses and the difficulty of production for immediate use when needed. Such disadvantages have been overcome by the present invention. Because the present receptacle is used to store and market the ice ultimately used to cool beverages and food, the receptacle is always located where the user requires an ice chest. Its lightweight and relatively inexpensive design makes its economical for use in this regard. Its compact and regular shape make receptacle 10 ideal for the packaging and marketing of granulated ice. These units may be stacked easily and transported over relatively great distances in order to reach potential users.

In use, users will find the present invention to be highly advantageous in terms of its convenience. No longer will it be necessary to store bulky ice chests for long periods of time until needed. Rather, a user will simply purchase the ice receptacle as packaging for the granulated ice required in any case.

The present invention has the added advantage of being completely disposable. Once the user has consumed all of the refreshments or other food contained within the ice receptacle, it may be used to store any refuse such as empty cans and bottles before disposing of the entire unit at the nearest trash facility. Thus not only does the user not have to transport an ice chest to his chosen area of recreation, but also he need not bear the added burden of transporting it home again.

The present invention may also be used to package soft drinks or other commodities likely to need refigeration. Commodities such as soda and beer are typically sold in modular units of six, twelve or twenty-four cans. Once purchased, the consumer must transfer these commodities into a refrigerator or ice chest to be cooled for drinking. The present invention may be used to package these items at the point of sale. The user then adds separately purchased ice and employs the receptacle in the manner described above.

Further, the present invention may be used as a simple disposable ice chest without its use as a packaging device. In this case, the receptacle is sold empty in its compact state as a disposable ice chest. A user then adds consumables and ice when desired. A primary advantage here is the lightweight design of the invention.

In describing the invention, reference has been made to a preferred embodiment in illustrative advantages of the invention. Those skilled in the art and familiar with the instant disclosure of the subject invention, may recognize additions, deletions, modifications, substitutions, and other changes which will fall within the pervue of the subject invention and the following claims.

What is claimed is:

1. A receptacle for packaging and storing particulate ice and selectively storing and cooling consumables comprising:

a bottom surface;

first and second opposing side walls connected to said bottom surface;

first and second opposing end walls connected to said bottom surface and said first and second side walls to form a container for receiving particulate ice; and an expandable closure means integrally connected to said container for selectively extending from a closed collapsed position for packaging particulate ice to a closed extended position for selectively storing and insulating consumables, said expandable closure means having, first and second upper side sections coextensive with said first and second opposing side walls, first and second upper end sections coextensive with said first and second opposing end wall and connected to said first and second upper side sections, each of said first and second upper end sections having a notch along an upper edge, first and second top flaps coextensive with said first and second upper side sections, and first and second locking flaps coextensive with said first and second top flaps, each of said first and second flap members having notches along an outward edge, said notches of said first and second flap members being operable to engage with said notches of said first and second upper end sections to maintain said container in the closed extended position.

2. A receptacle as defined in claim 1 wherein each of said first and second upper end sections further comprise:

first and second upper end portions; and a main end portion;

wherein said main end portion being positioned between said first and second upper end portions, said main end portion and said first and second end portions being separated by lines operable to collapsibly fold said expandable closure means.

3. A receptacle as defined in claim 1 further comprising:

means for maintaining a consumable in a partially exposed position and for cooling the consumable when said container is in the closed extended position.

4. A receptacle as defined in claim 3 wherein said consumable maintaining and cooling means comprises:

at least one access opening having a plurality of pie-shaped flaps which are operable to extend downward and frictionally engage a consumable.

5. A receptacle as defined in claim 1 further comprising:

means for waterproofing said container.

* * * * *